US008516721B2

(12) United States Patent
Mahoney

(10) Patent No.: US 8,516,721 B2
(45) Date of Patent: Aug. 27, 2013

(54) ARTICLES OF FOOTWEAR

(75) Inventor: Christopher J. Mahoney, Concord, MA (US)

(73) Assignee: Saucony IP Holdings LLC, Rockford, MI (US)

( * ) Notice: Subject to any disclaimer, the term of this patent is extended or adjusted under 35 U.S.C. 154(b) by 446 days.

(21) Appl. No.: 12/987,708

(22) Filed: Jan. 10, 2011

(65) Prior Publication Data

US 2012/0174433 A1 Jul. 12, 2012

(51) Int. Cl.
*A43B 1/10* (2006.01)

(52) U.S. Cl.
USPC ..... 36/50.1; 36/11.5; 36/25 R; 36/45; 36/102; 36/59 C

(58) Field of Classification Search
USPC ..... 36/11.5, 25 R, 45, 50.1, 28, 88, 91, 36/102, 59 R, 59 C
See application file for complete search history.

(56) References Cited

U.S. PATENT DOCUMENTS

| | | | | |
|---|---|---|---|---|
| 2,147,197 | A | | 2/1939 | Glidden |
| 2,563,092 | A | | 8/1951 | Zacks |
| 3,067,752 | A | | 12/1962 | Schaller et al. |
| 4,136,468 | A | | 1/1979 | Munschy |
| 4,178,703 | A | | 12/1979 | Pols |
| 4,255,876 | A | | 3/1981 | Johnson |
| 4,282,657 | A | | 8/1981 | Antonious |
| 4,343,097 | A | | 8/1982 | Sasaki |
| 4,354,319 | A | | 10/1982 | Block et al. |
| 4,392,313 | A | | 7/1983 | Linecker |
| 4,413,431 | A | | 11/1983 | Cavanagh |
| 4,447,967 | A | | 5/1984 | Zaino et al. |
| 4,453,322 | A | * | 6/1984 | Marsh ..... 36/11.5 |
| 4,476,639 | A | | 10/1984 | Zaccaria |
| 4,519,148 | A | | 5/1985 | Sisco |
| 4,562,651 | A | * | 1/1986 | Frederick et al. ..... 36/102 |
| 4,599,811 | A | | 7/1986 | Rousseau |
| 4,741,114 | A | | 5/1988 | Stubblefield |
| 4,756,098 | A | | 7/1988 | Boggia |
| 4,813,158 | A | | 3/1989 | Brown |
| 4,845,864 | A | | 7/1989 | Corliss |
| 5,176,624 | A | | 1/1993 | Kuehnreich |
| 5,211,672 | A | | 5/1993 | Andujar |
| 5,221,104 | A | | 6/1993 | Bejean et al. |

(Continued)

FOREIGN PATENT DOCUMENTS

| | | | |
|---|---|---|---|
| DE | 2461701 | A1 | 11/1976 |
| EP | 743023 | A1 | 11/1996 |

(Continued)

*Primary Examiner* — Marie Patterson
(74) *Attorney, Agent, or Firm* — Warner Norcross & Judd LLP

(57) ABSTRACT

An article of footwear that includes a sole defining a bending feature (e.g., a groove) between a phalanges portion and a metatarsus portion of the sole. The bending feature allows the phalanges sole portion to articulate upward with respect to the metatarsus sole portion. An upper is attached to the sole and defines a foot void for receiving a human foot. The upper has a phalanges portion that defines at least one toe receiver volume. The at least one toe receiver volume defines a raised shape with respect to an adjacent metatarsus portion of the upper. Articulation of the phalanges sole portion and substantially unrestricted toe lift movement into the at least one toe receiver volume allows substantially unrestricted upward toe flexion of a received foot in the foot void.

39 Claims, 11 Drawing Sheets

(56) References Cited

U.S. PATENT DOCUMENTS

| | | | | |
|---|---|---|---|---|
| 5,544,429 | A * | 8/1996 | Ellis, III | 36/25 R |
| 5,625,966 | A * | 5/1997 | Perotto et al. | 36/117.2 |
| 5,774,898 | A | 7/1998 | Malpee | |
| 5,819,439 | A | 10/1998 | Sanchez | |
| 5,918,385 | A * | 7/1999 | Sessa | 36/59 C |
| 6,018,889 | A * | 2/2000 | Friton | 36/28 |
| 6,038,792 | A | 3/2000 | Hauter | |
| 6,151,804 | A | 11/2000 | Hieblinger | |
| 6,233,846 | B1 | 5/2001 | Sordi | |
| 6,237,251 | B1 * | 5/2001 | Litchfield et al. | 36/25 R |
| 6,360,456 | B2 | 3/2002 | Davis et al. | |
| 6,405,459 | B1 | 6/2002 | Prevost et al. | |
| 6,516,540 | B2 | 2/2003 | Seydel et al. | |
| 6,557,274 | B2 | 5/2003 | Litchfield et al. | |
| 6,634,121 | B2 * | 10/2003 | Sordi | 36/102 |
| 6,670,029 | B2 | 12/2003 | Norton et al. | |
| 6,729,046 | B2 * | 5/2004 | Ellis, III | 36/25 R |
| 6,757,991 | B2 * | 7/2004 | Sussmann | 36/50.1 |
| 6,857,204 | B1 | 2/2005 | Davis et al. | |
| 6,962,011 | B2 | 11/2005 | Drennan | |
| 7,082,697 | B2 | 8/2006 | Ellis, III | |
| 7,159,341 | B2 | 1/2007 | Davis et al. | |
| 7,249,426 | B2 * | 7/2007 | Romano et al. | 36/93 |
| 7,347,011 | B2 | 3/2008 | Dua et al. | |
| D574,583 | S | 8/2008 | St-Louis et al. | |
| 7,475,501 | B1 | 1/2009 | DeToro et al. | |
| D589,692 | S | 4/2009 | McClaskie | |
| 7,513,064 | B2 * | 4/2009 | Fuerst | 36/11.5 |
| D594,193 | S | 6/2009 | Duffy | |
| D594,195 | S | 6/2009 | Nakano | |
| D602,237 | S | 10/2009 | Roundhouse | |
| D604,932 | S | 12/2009 | Le | |
| D605,838 | S | 12/2009 | Foust | |
| 7,636,974 | B2 | 12/2009 | Meschter et al. | |
| 7,703,221 | B2 | 4/2010 | Richards et al. | |
| D615,739 | S | 5/2010 | Andersen et al. | |
| D619,348 | S | 7/2010 | Schwartz et al. | |
| D622,490 | S | 8/2010 | McClaskie | |
| 7,793,429 | B2 | 9/2010 | Ellis, III | |
| 7,805,860 | B2 | 10/2010 | Fliri | |
| 7,814,598 | B2 | 10/2010 | Dua et al. | |
| 2001/0005947 | A1 * | 7/2001 | Sordi | 36/102 |
| 2002/0014021 | A1 * | 2/2002 | Ellis, III | 36/25 R |
| 2002/0069558 | A1 | 6/2002 | Wilkinson | |
| 2002/0078591 | A1 * | 6/2002 | Morrone | 36/8.3 |
| 2002/0144429 | A1 * | 10/2002 | Hay | 36/25 R |
| 2006/0161090 | A1 | 7/2006 | Lee | |
| 2007/0220777 | A1 | 9/2007 | Richardson | |
| 2008/0163515 | A1 | 7/2008 | Rackiewicz et al. | |
| 2008/0216361 | A1 | 9/2008 | Vitulli | |
| 2009/0000149 | A1 * | 1/2009 | Grove et al. | 36/88 |
| 2009/0145005 | A1 | 6/2009 | Murphy et al. | |
| 2009/0217552 | A1 | 9/2009 | Paintin et al. | |
| 2009/0282700 | A1 | 11/2009 | Dillon et al. | |
| 2010/0299962 | A1 | 12/2010 | Fliri et al. | |
| 2010/0325916 | A1 | 12/2010 | Dua et al. | |

FOREIGN PATENT DOCUMENTS

| | | | |
|---|---|---|---|
| EP | 1602293 | A1 | 12/2005 |
| WO | WO-9817138 | A1 | 4/1998 |
| WO | WO-2006005139 | A1 | 1/2006 |
| WO | WO-2009156625 | A2 | 12/2009 |

* cited by examiner

ARTICLES OF FOOTWEAR

TECHNICAL FIELD

This disclosure relates to outsoles for articles of footwear.

BACKGROUND

Articles of footwear, such as shoes, are generally worn while exercising to protect and provide stability of a user's feet. In general, shoes include an upper portion and a sole. When the upper portion is secured to the sole, the upper portion and the sole together define a void that is configured to securely and comfortably hold a human foot. Often, the upper portion and/or sole are/is formed from multiple layers that can be stitched or adhesively bonded together. For example, the upper portion can be made of a combination of leather and fabric, or foam and fabric, and the sole can be formed from at least one layer of natural rubber. Often materials are chosen for functional reasons, e.g., water-resistance, durability, abrasion-resistance, and breathability, while shape, texture, and color are used to promote the aesthetic qualities of the shoe. The sole generally provides support for a user's foot and acts as an interface between the user's foot and the ground.

SUMMARY

One aspect of the disclosure provides an article of footwear that includes a sole defining a bending feature (e.g., a groove) between a phalanges portion and a metatarsus portion of the sole. The bending feature allows the phalanges sole portion to articulate upward with respect to the metatarsus sole portion. An upper is attached to the sole and defines a foot void for receiving a human foot. The upper has a phalanges portion that defines at least one toe receiver volume. The at least one toe receiver volume defines a raised shape with respect to an adjacent metatarsus portion of the upper. Articulation of the phalanges sole portion and substantially unrestricted toe lift movement into the at least one toe receiver volume allows substantially unrestricted upward toe flexion of a received foot in the foot void.

Implementations of the disclosure may include one or more of the following features. In some implementations, the sole defines a substantially uniform thickness from a toe end to a heel end of the article of footwear. The sole may comprise ethylene vinyl acetate (EVA) (e.g., a high abrasion EVA resistant to wear). In some examples, the sole includes a sole body, a first ground contact pad disposed on a heel portion of the sole body, a second ground contact pad disposed on a medial metatarsus portion of the sole body, and a third ground contact pad disposed on a medial phalanges portion of the sole body. Bottom surfaces of the ground contact pads and a bottom surface of the sole body collectively define a ground contact surface of the sole. The bottom surface of the sole body may define traction lugs having a heelward shoulder, which may define a substantially right angle edge having a substantially non-radiused corner. The sole body may define a ground contact pod in a medial portion of the sole body between the first and second ground contact pads. The ground contact pod has a bottom surface common with the ground contact surface of the sole. In some examples, the ground contact pads comprise carbon rubber. Moreover, the ground contact pads may define concentric grooves. At least one groove of each ground contact pad may define a shoulder having a substantially non-radiused edge.

In some implementations, the upper includes an enclosure layer and a reinforcing layer disposed on at least a forefoot portion of enclosure layer, the reinforcing layer having webs extending from a common location in a medial forefoot portion of the upper to spaced locations near a lateral edge of the upper. The common location may be near a foot receiving opening defined by the upper. In some examples, the reinforcing layer extends continuously along a periphery of the forefoot portion of the enclosure layer. Moreover, the webs define an arcuate path. The reinforcing layer may comprise at least one of a thermoplastic polyurethane and a heat pressed rubber. In some examples, the enclosure layer has an inner surface and an outer surface. The inner enclosure layer surface can be the inner most surface of the upper and the outer enclosure layer surface can be the outermost surface for a portion of the upper.

In some implementations, the article of footwear includes a first strap and a second strap. The first strap has a first end secured to one of lateral and medial heel portions of the upper near a foot receiving opening defined by the upper and a free second end releasably securable to the other of the lateral and medial heel portions of the upper. The first end of the first strap may connected directly to the enclosure layer. The second strap has a first end secured to a medial portion of the upper near the foot receiving opening opposite of the first strap and a free second end releasably securable to a lateral portion of the upper. In some examples, the second ends of the first and second straps are releasably securable to the upper using hook and loop fasteners.

Another aspect of the disclosure provides an article of footwear that includes a sole attached to an upper. The upper includes an enclosure layer and a reinforcing layer disposed on at least a forefoot portion of enclosure layer. The reinforcing layer has webs extending from a common location in a medial forefoot portion of the upper to spaced locations near a lateral edge of the upper.

In some implementations, the common location is near a foot receiving opening defined by the upper. The webs may define an arcuate path. The reinforcing layer may extend continuously along a periphery of the forefoot portion of the enclosure layer. In some examples, the reinforcing layer comprises at least one of a thermoplastic polyurethane and a heat pressed rubber. In some examples, the enclosure layer has an inner surface and an outer surface. The inner enclosure layer surface can be the inner most surface of the upper and the outer enclosure layer surface can be the outermost surface for a portion of the upper.

In some implementations, the article of footwear includes a first strap and a second strap. The first strap has a first end secured to one of lateral and medial heel portions of the upper near a foot receiving opening defined by the upper and a free second end releasably securable to the other of the lateral and medial heel portions of the upper. The first end of the first strap may connected directly to the enclosure layer. The second strap has a first end secured to a medial portion of the upper near the foot receiving opening opposite of the first strap and a free second end releasably securable to a lateral portion of the upper. In some examples, the second ends of the first and second straps are releasably securable to the upper using hook and loop fasteners.

In yet another aspect of the disclosure, a sole assembly for an article of footwear includes a sole body comprising ethylene vinyl acetate, a first ground contact pad disposed on a heel portion of the sole body, a second ground contact pad disposed on a medial metatarsus portion of the sole body, and a third ground contact pad disposed on a medial phalanges portion of the sole body. The ground contact pads comprise rubber. Moreover, bottom surfaces of the ground contact pads and a bottom surface of the sole body collectively define a ground contact surface of the sole assembly.

In some implementations, the bottom surface of the sole body defines traction lugs having a heelward shoulder, which may define a substantially right angle edge having a substantially non-radiused corner. The sole body may define a bending feature (e.g., a groove) between a phalanges portion of the sole body and a metatarsus portion of the sole body for allowing articulation of the phalanges sole body portion with respect to the metatarsus sole body portion. In some examples, the sole body defines a ground contact pod in a medial portion of the sole body between the first and second ground contact pads. The ground contact pod has a bottom surface common with the ground contact surface of the sole assembly. The ground contact pads may comprise carbon rubber. Moreover, the ground contact pads may define concentric grooves (e.g., channels, molded siping, or razor siping). At least one groove of each ground contact pad may define a shoulder having a substantially non-radiused edge. A thickness of a forefoot portion of the sole assembly may be substantially equal to a thickness of a heel portion of the sole assembly.

In another aspect, an article of footwear includes a sole assembly connected to an upper assembly. The sole assembly includes a sole body comprising ethylene vinyl acetate, a first ground contact pad disposed on a heel portion of the sole body, a second ground contact pad disposed on a medial metatarsus portion of the sole body, and a third ground contact pad disposed on a medial phalanges portion of the sole body. Bottom surfaces of the ground contact pads and a bottom surface of the sole body collectively define a ground contact surface of the sole assembly. The upper assembly includes a mesh upper enclosure layer, a first reinforcing layer disposed on the enclosure layer in a forefoot portion of the upper assembly, a second reinforcing layer disposed on the enclosure layer in at least a heel portion of the upper assembly. The first reinforcing layer includes webs extending from a common location in a medial forefoot portion of the upper assembly to spaced locations near a lateral edge of the upper assembly.

In some implementations, the enclosure layer has an inner surface and an outer surface. The inner enclosure layer surface can be the inner most surface of the upper assembly and the outer enclosure layer surface can be the outermost surface for a portion of the upper assembly. The common location may be near a foot receiving opening defined by the upper assembly. The first reinforcing layer may extend continuously along a periphery of the forefoot portion of the enclosure layer. Moreover, the webs may define an arcuate path. In some examples, the first reinforcing layer comprises at least one of a thermoplastic polyurethane and a heat pressed rubber. The second reinforcing layer may comprise a synthetic suede.

In some implementations, the article of footwear includes a first strap and a second strap. The first strap has a first end secured to one of lateral and medial heel portions of the upper near a foot receiving opening defined by the upper and a free second end releasably securable to the other of the lateral and medial heel portions of the upper. The first end of the first strap may connected directly to the enclosure layer. The second strap has a first end secured to a medial portion of the upper near the foot receiving opening opposite of the first strap and a free second end releasably securable to a lateral portion of the upper. In some examples, the second ends of the first and second straps are releasably securable to the upper using hook and loop fasteners. Moreover, the first and second straps may extend continuously from the second reinforcing layer as a unitary piece.

The bottom surface of the sole body may define fraction lugs having a heelward shoulder, which may define a substantially right angle edge having a substantially non-radiused corner. In some examples, the sole body defines a bending feature (e.g., a groove or channel) between a phalanges portion of the sole body and a metatarsus portion of the sole body for allowing articulation of the phalanges sole body portion with respect to the metatarsus sole body portion.

In some examples, the sole body defines a ground contact pod in a medial portion of the sole body between the first and second ground contact pads. The ground contact pod has a bottom surface common with the ground contact surface of the sole assembly. The ground contact pads may comprise carbon rubber. The ground contact pads, in some examples, define concentric grooves. At least one groove of each ground contact pad may define a shoulder having a substantially non-radiused edge. A thickness of a forefoot portion of the sole assembly may be substantially equal to a thickness of a heel portion of the sole assembly, thereby providing substantially no heel lift.

In yet another aspect, an article of footwear includes a sole and an upper attached to the sole. The upper includes a mesh enclosure layer extending from a toe end of the upper to a heel end of the upper, a thermo plastic polyurethane reinforcing layer applied to an outer surface of the mesh enclosure layer in a forefoot portion of the upper, and a non-woven reinforcing layer applied to the outer surface of the mesh enclosure layer in a heel portion of the upper. The non-woven reinforcing layer defines a first strap extending from a medial portion of the upper proximate a foot opening defined by the upper to a distal free end releasably securable to a lateral portion of the upper. The non-woven reinforcing layer also defines a second strap extending from one of lateral and medial heel portions of the upper near the foot opening to a distal free end releasably securable to the other of the lateral and medial heel portions.

The details of one or more implementations of the disclosure are set forth in the accompanying drawings and the description below. Other aspects, features, and advantages will be apparent from the description and drawings, and from the claims.

Figure 1:
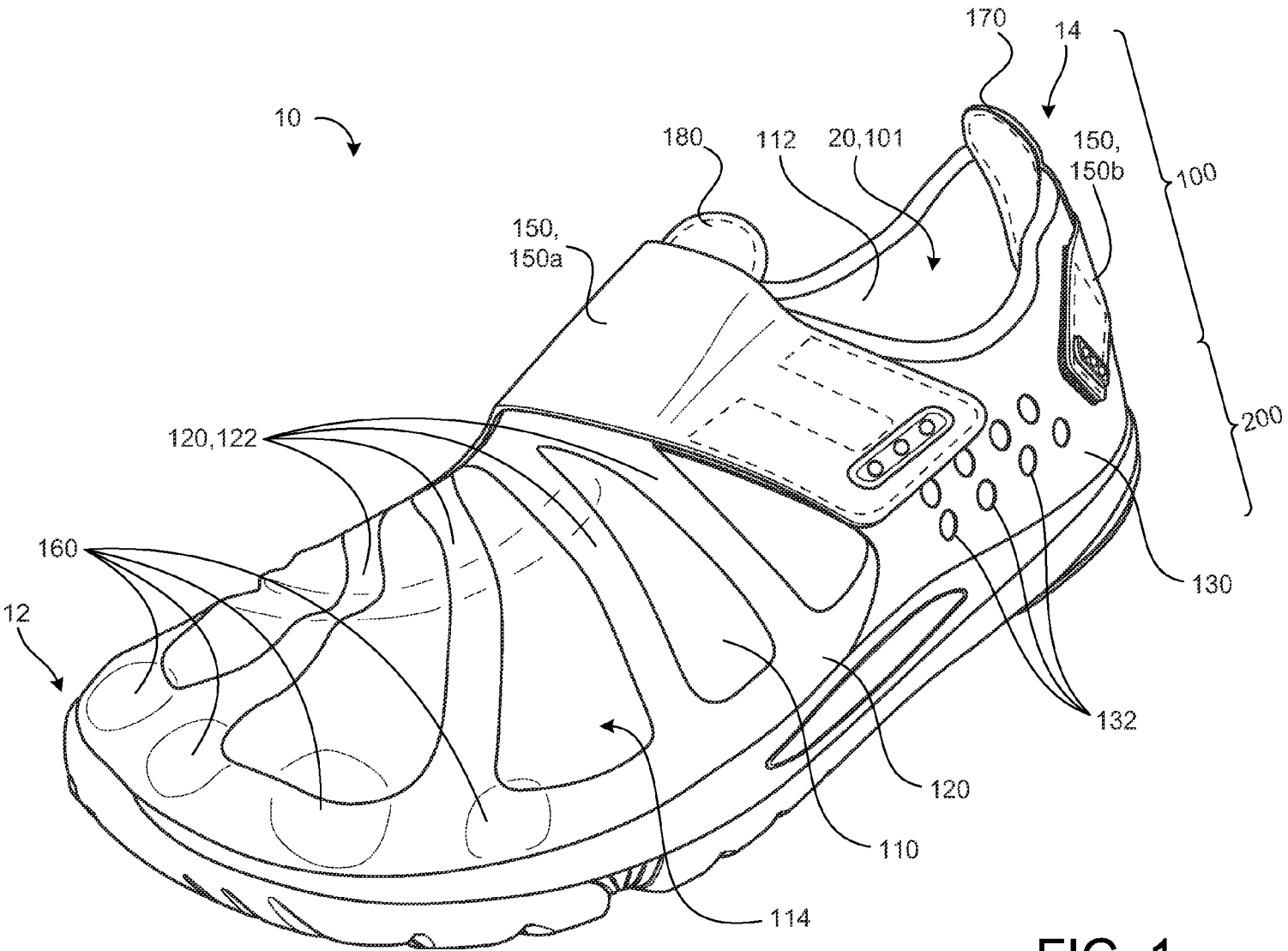
FIG. 1 is a perspective view of an exemplary article of footwear.
Figure 2:
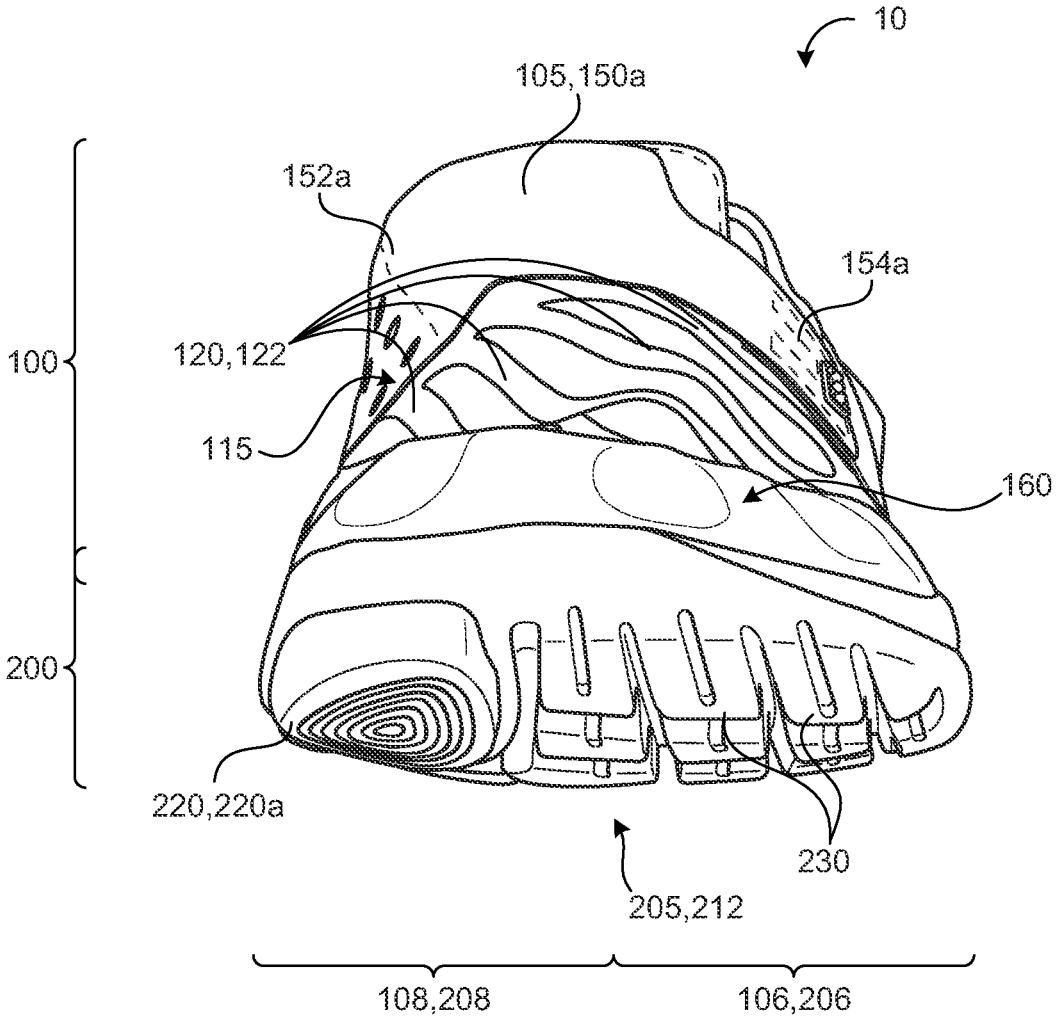
FIG. 2 is a front view of the article of footwear shown in FIG. 1.
Figure 3:
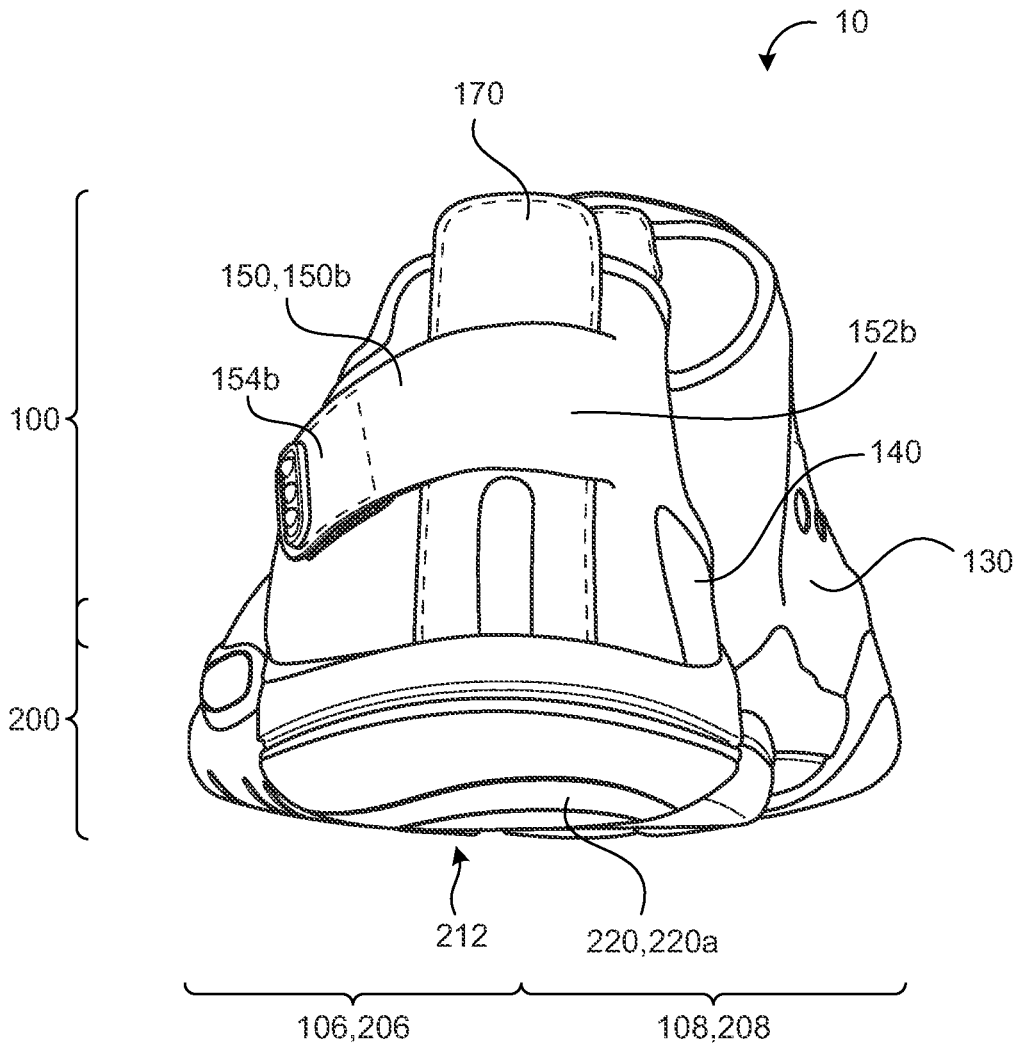
FIG. 3 is a rear view of the article of footwear shown in FIG. 1.
Figure 4B:
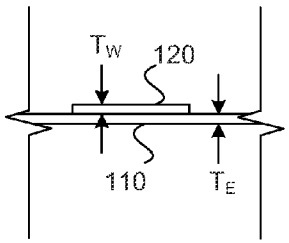
FIG. 4B is a section view of a portion of an upper of the article of footwear shown in FIG. 4B, along line 4B-4B.
Figure 4A:
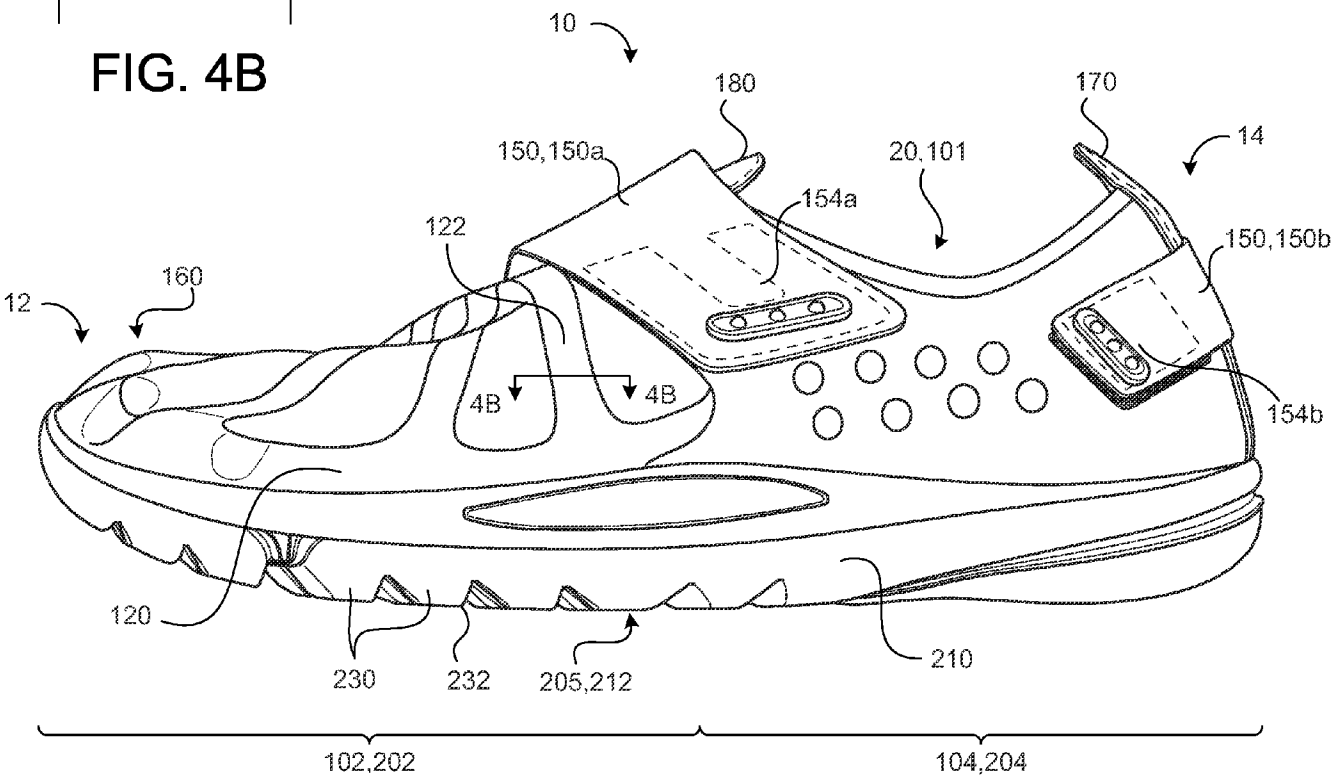
FIG. 4A is a lateral side view of the article of footwear shown in FIG. 1.
Figure 5:
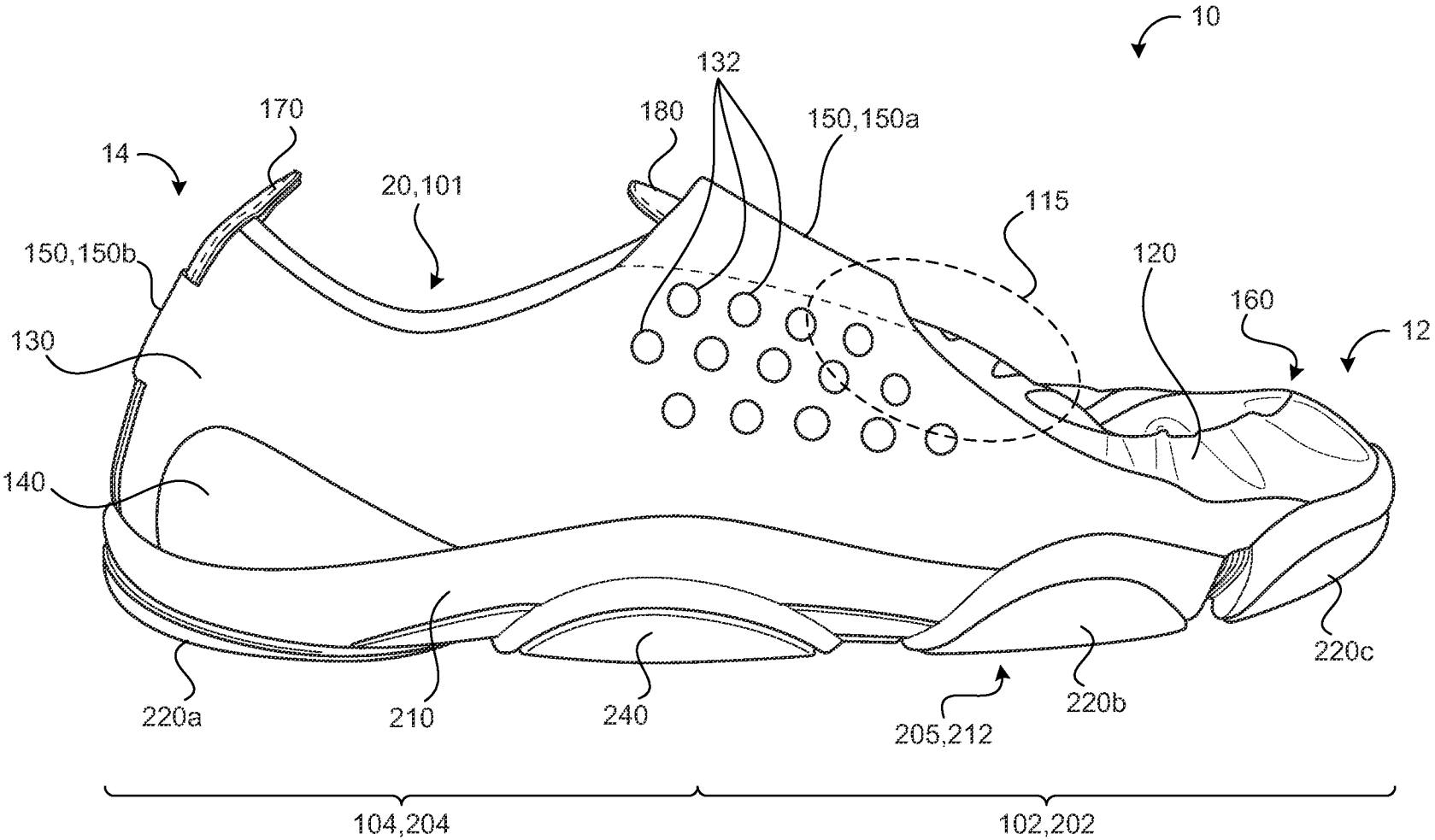
FIG. 5 is a medial side view of the article of footwear shown in FIG. 1.
Figure 6:
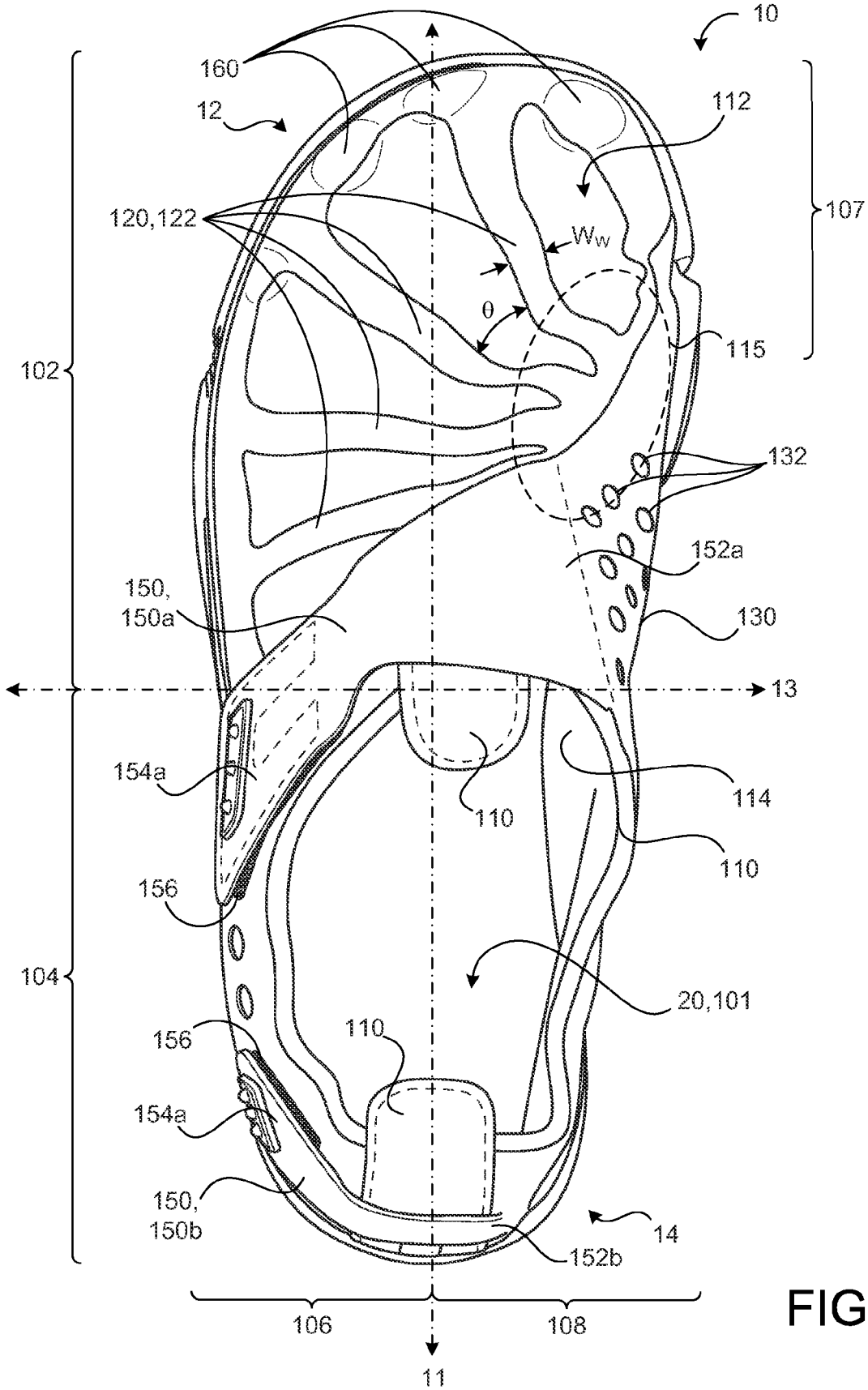
FIG. 6 is a top view of the article of footwear shown in FIG. 1.
Figure 7:
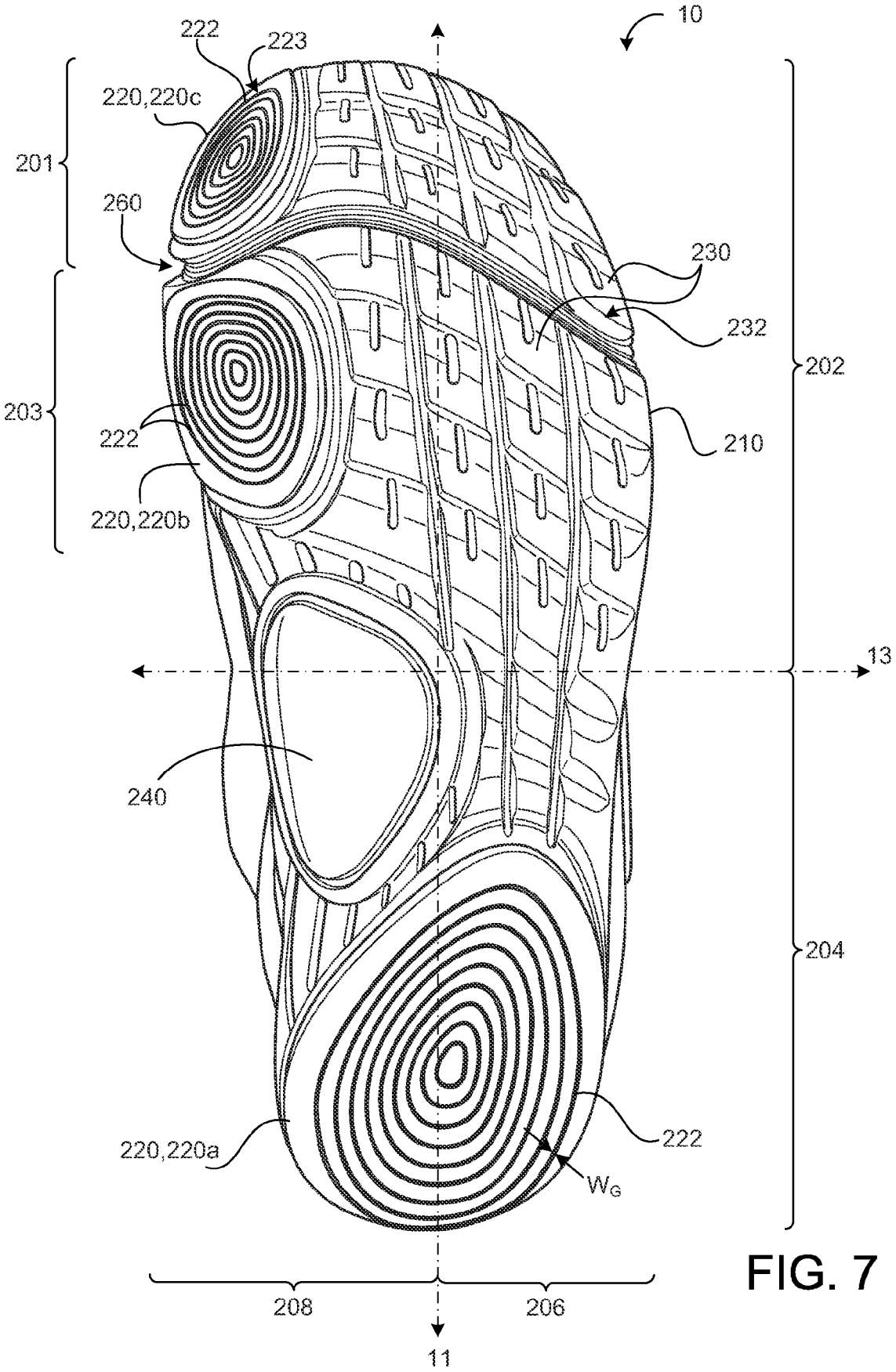
FIG. 7 is a bottom view of the article of footwear shown in FIG. 1.

Like reference symbols in the various drawings indicate like elements. By way of example only, all of the drawings are directed to an article of footwear suitable to be worn on a left foot. The invention also includes the mirror images of the drawings, i.e. an article of footwear suitable to be worn on a right foot.

DETAILED DESCRIPTION

A minimalist running shoe can have a relatively low weight (e.g., less than about 4.5 ounces for a men's size 9) and few materials or components as compared to traditional running shoes, to provide a feeling of little resistance on a user's foot (e.g., such as a feeling of running barefoot), while still protecting a user's foot from surface abrasions or foreign objects on the ground. The shoe can have a minimum amount of material to securely receive and hold a user's foot.

Referring to FIGS. 1-7, in some implementations, an article of footwear 10 (e.g., a shoe) has an upper assembly 100 connected or attached to a sole assembly 200 (e.g., by stitching, adhesives, or a combination thereof). Together, the upper assembly 100 and the sole assembly 200 define a foot void 20 configured to securely and comfortably hold a human foot. The foot is received through a foot receiving opening 101 defined by the upper assembly 100. The upper assembly 100 and the sole assembly 200 each have a corresponding forefoot portion 102, 202, a heel portion 104, 204, a lateral portion 106, 206, and a medial portion 108, 208. The article of footwear 10 defines a longitudinal axis 11 along a walking direction and a perpendicular transverse axis 13. The sole assembly 200 provides a contact interface between a user's foot and the ground during walking or running.

In some implementations, the upper assembly 100 includes an enclosure layer 110 and first and second reinforcing layers 120, 130 disposed on (e.g., stitched, adhered, or otherwise attached to) the enclosure layer 110. The enclosure layer 110 is shaped to at least partially defined the foot void 20 for receiving the user's foot. In the examples shown, the enclosure layer 110 is a single layer shaped to receive and substantially surround the user's foot. The enclosure layer 110 can be a base layer for the upper assembly 100 that receives the applied reinforcing layers 120, 130. The enclosure layer 110 may extend continuously from a toe end 12 of the shoe 10 to a heel end 14 of the shoe 10. The enclosure layer 110, in some examples, comprises a mesh material (e.g., a 2-way, 4-way, or three-dimensional stretch mesh material) that can stretch to conform to and/or accommodate receipt and movement of a foot (e.g., including toe flexion, extension, and lift). The enclosure layer 110 can stretch to allow foot expansion during running as well during a ground contact phase of a running stride. The enclosure layer 110 has an inner surface 112 contacting the user's foot as an inner most surface of the upper assembly 100 and an outer surface 114 that is the outermost surface of some portions of the upper assembly 100. The enclosure layer 110 may have a thickness $T_E$ of between about 0.2 mm and about 2 mm.

The first reinforcing layer 120 is disposed on the enclosure layer 110 in the forefoot portion 102 of the upper assembly 100. The first reinforcing layer 110 can be configured to convey or transmit fitting and/or wear forces about the foot receiving opening 101 or a closure device thereabout to the sole assembly 100. The first reinforcing layer 120 may comprise a thermoplastic polyurethane or a heat pressed rubber applied, adhered or melted onto the enclosure layer 110 (e.g., onto the outer surface 114). In some examples, the first reinforcing layer 120 is an injected plastic material formed on the enclosure layer 110 as a continuous reinforcing structure securely bonded to the enclosure layer 110. The first reinforcing layer 120 can be configured to allow stretching of the mesh enclosure layer 110 in some regions, while restricting stretch in other regions (e.g., to provide support, shape, and/or a fit of the shoe 10). The stretch restriction can be partial or complete. For example, the first reinforcing layer 120 may be inelastic or elastic (e.g., and having a different level of stretch than the enclosure layer 110). In some examples, the first reinforcing layer 120 extends continuously along a periphery of the forefoot portion of the enclosure layer 110 (e.g., along an outer perimeter of the shoe 10).

In the examples shown, the first reinforcing layer 120 includes one or more reinforcing strips, bands, or webs 122 arranged to form a cage over the forefoot portion 102 of the upper assembly 100. Each reinforcing web 122 may extend from a common region 105 within an intersection of the forefoot and medial portions 102, 106 of the upper assembly 100 (e.g., a medial forefoot portion of the upper assembly 100) to the lateral portion of the upper assembly 100 (or the forefoot and lateral portions 202, 206 of the upper assembly 100) and optionally connecting to the sole assembly 200. The first reinforcing layer 120 may be connected to both the lateral and medial portions 206, 208 of the sole assembly 200 and extend over the enclosure layer therebetween (e.g., along a linear or arcuate path), at least partially surrounding a received foot. Moreover, each reinforcing web may extend radially away from the common region 105 (e.g., in a fan pattern). For example, adjacent reinforcing webs 122 may have an angle of separation θ of between about 5° and about 45°. The reinforcing webs 122 may have a thickness $T_W$ of between about 0.1 mm and about 1 mm and a width $W_W$ of between about 0.1 mm and about 1 mm.

The second reinforcing layer 130 may be disposed on the enclosure layer 110 in the heel portion 104 of the upper assembly 100. The second reinforcing layer 130 may comprise a non-woven material, such as a synthetic suede, for providing support, comfort, and a soft feel; however, other materials are possible as well (e.g., a woven, knit, or non-woven material). The second reinforcing layer 130 may form a heel cup to aid heel retention in the shoe 10. For example, the reinforcing layer 130 may support at least a portion of a user's heel and transmit fitting or wear forces to the sole assembly 200. Moreover, the second reinforcing layer 130 may define apertures 132 for ventilation of the upper assembly 100. The apertures 132 may have a diameter of between about 0.5 mm and about 1 cm; however, other shapes and sizes of apertures 132 may be used as well.

In some implementations, the upper assembly 100 includes a third reinforcing layer 140 disposed in a medial heel region 109 of the upper assembly 100 (e.g., as an outermost layer) to provide additional support against foot pronation during walking or running. The third reinforcing layer 140 may comprise a thermoplastic polyurethane, a rigid or semi-rigid plastic, or any other suitable material.

In some implementations, the upper assembly 100 includes one or more closure devices 150 configured to secure receipt foot in the shoe 10. The closure device 150 can decrease an inner volume of the foot void 20, thus tightening at least a portion of the upper assembly 100 around the received foot. The closure device 150 may include straps and/or laces. In the examples shown, the shoe 10 includes a top strap 150*a* and a heel strap 150*b*. The top strap 150*a* has a first end 152*a* attached to one of the lateral portion 106 or the medial portion 108 of the upper assembly 100 near the foot opening 101 and a free second end 154*a* releasably securable (e.g., via a releasable fastener 156, such as hook and loop fasteners, a buckle, snaps, friction device, etc.) to the other of the lateral medial portions 106, 108 (i.e., an opposite side) of the upper assembly 100. The heel strap 150*b* has a first end 152*b* attached to one of the lateral portion 106 or the medial portion 108 of the upper assembly 100 near the foot opening 101 at the heel end 14 of the shoe 10 and a second end 154*b* releasably securable (e.g., via a releasable fastener 156, such as hook and loop fasteners, a buckle, snaps, friction device, etc.) to the other of the lateral and medial portions 106, 108 (opposite side) of the upper assembly 100 at the heel end 14 of the shoe 10. In some implementations, the second reinforcing layer 130 defines the first strap 150*a* extending from a medial portion 108 of the upper assembly 100 proximate the foot opening 101 defined by the upper assembly 100 to a distal free end 154*a* releasably securable to the lateral portion 106 of the upper assembly 100. The second reinforcing layer 130 may also define the second strap 150*b* extending from one of the lateral and medial portions 106, 108 of the upper assembly 100 in the heel portion 104 near the foot opening 101 to a distal free end 154*b* releasably securable to the other of the lateral and medial heel portions.

The combination of the top strap 150*a* and heel strap 150*b* allows a user to customize a fit of the shoe 10 at least in the heel portion 104 of the upper assembly 100 (e.g., about the foot opening 101). Moreover, the straps 150*a*, 105*b* securely hold the user's foot in the shoe void 20 while the remaining portions of the upper assembly 100 may stretch or elastically deformed during wear.

Referring to FIGS. 1-6 and 9, a toe box portion 107 of the upper assembly 100 may define one or more toe receivers 160 (e.g., substantially convex or dome shaped receptacles or volumes) configured to receive one or more lifted toes of the received foot. In the examples shown, the toe box portion 107 includes five raised toe receivers 160; however, other arrangements are possible as well. For example, the upper assembly 100 may define one continuous toe receiver 160 in the toe box portion 107 for receiving all lifted toes of a foot or 2-4 toe receivers 140, any one of which may receive multiple lifted toes. In some implementations, the enclosure layer 110 includes excess material in the toe box portion 107 to form each toe receiver 160. The toe receiver(s) 160 allow substantially unimpeded or unrestricted toe lifting of a user's foot while walking or running. The first reinforcing layer 130 may be configured or shaped to extend between and/or around the toe receiver(s) 160, thus not covering the toe receiver(s) 160, so as not to restrict toe lift in those regions and optionally to further define a boundary around each respective toe receiver 160.

Figure 9:
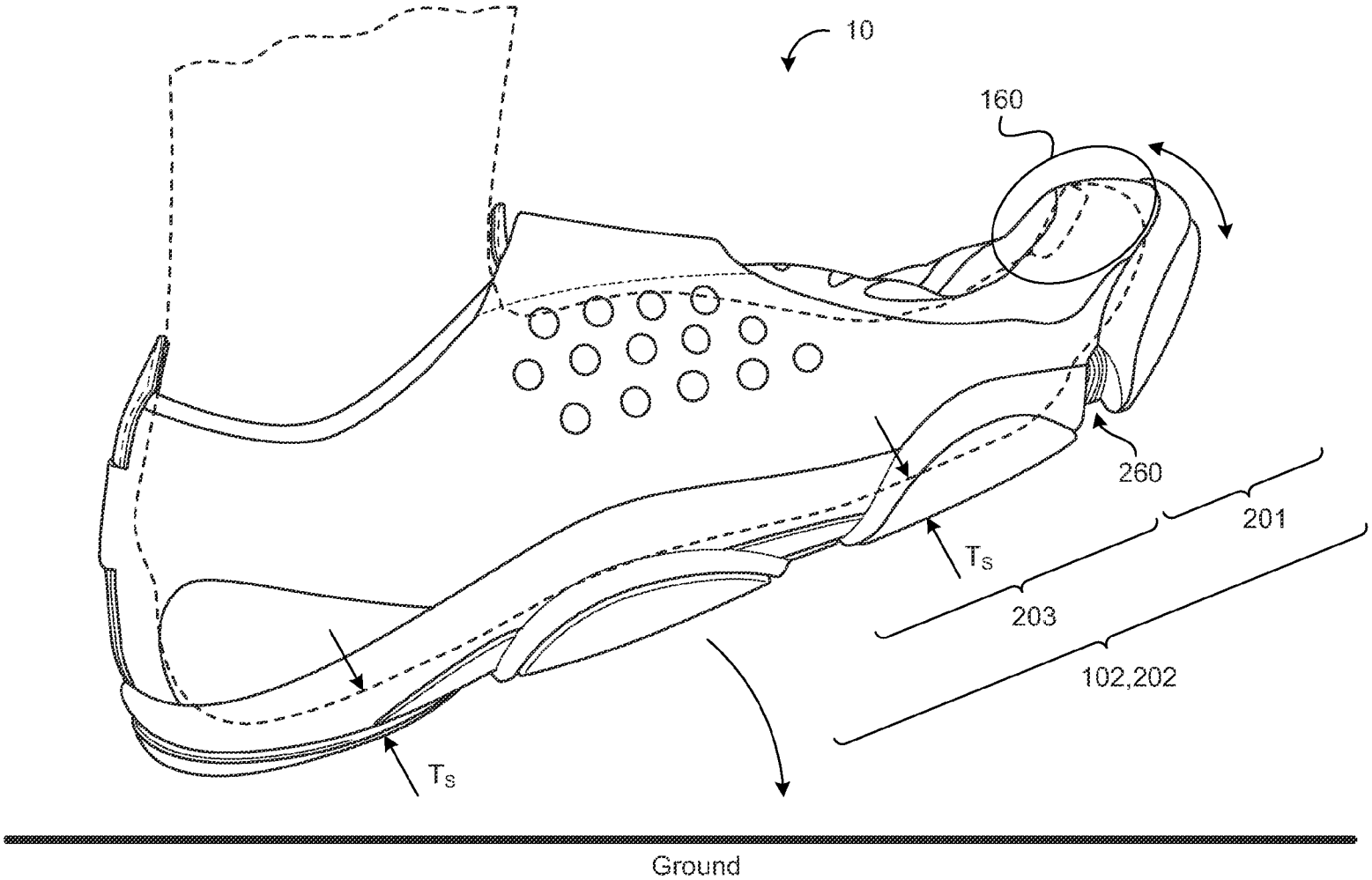
FIG. 9 is a side view of a person flexing his/her toes upward in an exemplary article of footwear before contacting the ground in a ground strike phase of a gait.

As the user runs, he/she may tend to lift reflects his/her toes at least slightly upward just before making contact with the ground, as shown in FIG. 9. The toe receiver(s) 160 receive the upwardly flexed toes, while substantially or completely allowing (i.e., not restricting) the upper toe flexion, as may occur without the toe receiver(s) 160. This provides the user with a natural unrestricted feel (e.g., as if running barefoot). To further aid unrestricted or substantially unrestricted toe lift, the sole assembly 200 may define or include a bending feature 260 (e.g., a groove or channel extending between lateral and medial edges of the sole assembly 100) that allows articulation or bending of a phalanges portion 210 of the sole assembly 200 with respect to a metatarsus portion 203 of the sole assembly 200. The bending feature 260 may be positioned below or near the ball or toe joint region (e.g., a metatarsal region) of the received foot. Articulation of the phalanges sole portion 201 and substantially unrestricted toe lift movement into the at least one toe receiver volume 160 allows substantially unrestricted upward toe flexion of a received foot in the foot void 20.

The upper assembly 100 may include a heel tab 170 disposed at the foot opening 101 at the heel end of the shoe 10. The user may pull on the heel tab 170 while donning the shoe 10 on his/her foot to assist movement of his/her foot into the foot void 20. Moreover, the upper assembly 100 may include a tongue tab 180 disposed at the foot opening 101 of the shoe 10 opposite of the heel tabs 170, which may be used for assisting insertion of the user's foot into the foot void 20.

Referring again to FIGS. 1-8, in some implementations, the sole assembly 200 includes a sole body 210 and at least one ground contact pad 220 disposed on a bottom surface 212 of the sole body 210. The sole body 210 may be a unitary body (e.g., a single component) comprised of a high abrasion ethylene vinyl acetate (EVA) foam or other foam, which may be wear or abrasion resistant. The at least one ground contact pad 220 may comprise natural rubber, snail rubber, or carbon rubber. For example, the at least one ground contact pad 220 may comprise at least one of snail rubber having a durometer of between about 50 Shore A and about 65 Shore A, a rubber having a coefficient of friction of about 0.9 and a durometer of between about 50 Shore A and about 65 Shore A, and a rubber having a coefficient of friction of about 1.1 and a durometer of between about 50 Shore A and about 65 Shore A. Other suitable materials may be used as well. Rather than having a rubber outsole covering an entire midsole (which provides a relatively heavy sole assembly), the sole assembly 200 may include ground contact pads 220 (e.g. rubber pads) disposed on the sole body 210 only in locations that generally experience high contact and friction forces. This provides a relatively lighter sole assembly 200.

Each ground contact pad 220 may define one or more grooves 222 (e.g., channels, molded siping, or razor siping) for traction. Each groove 222 may have at least one shoulder edge 223 with the ground contact surface 205 of the sole assembly 200. The at least one shoulder edge 223 may define a right angle with a substantially non-radiused, non-chamfered corner. In some examples, the shoulder edge is slightly radiused for mold release of molded ground contact pads 220. In the examples shown, the ground contact pads 220 define several substantially concentric grooves 222 (e.g., elliptical patterns along the ground contact surface 205) to provide traction in every direction of mobility. For example, groove edges 223 running substantially along the longitudinal axis 11 of the shoe 10 can provide traction or slip resistance against ground contact forces incurred by the ground contact pad 220 along the transverse axis 13 of the shoe 10 (e.g., as incurred during side-to-side movements of the user). Similarly, groove edges 223 running substantially along the transverse axis 13 of the shoe 10 can provide traction or slip resistance against ground contact forces incurred by the ground contact pad 220 along the longitudinal axis 11 of the shoe 10 (e.g., as incurred during forward/rearward propulsion in a walking direction). In the example shown in FIG. 7, the ground contact pads 220 define relatively narrow grooves 222 (e.g., molded siping or razor siping) having a width $W_G$ of between about 0.1 mm and about 1 mm. In the example shown in FIG. 8, the ground contact pads 220 define relatively wider grooves 222 (e.g., molded or cut grooves) having a width $W_G$ of between about 1 mm and about 5 mm. Other groove widths and configurations are possible as well to achieve certain traction and slip resistance characteristics in various environments (e.g., hot and dry, cold and wet, etc.).

Figure 8:
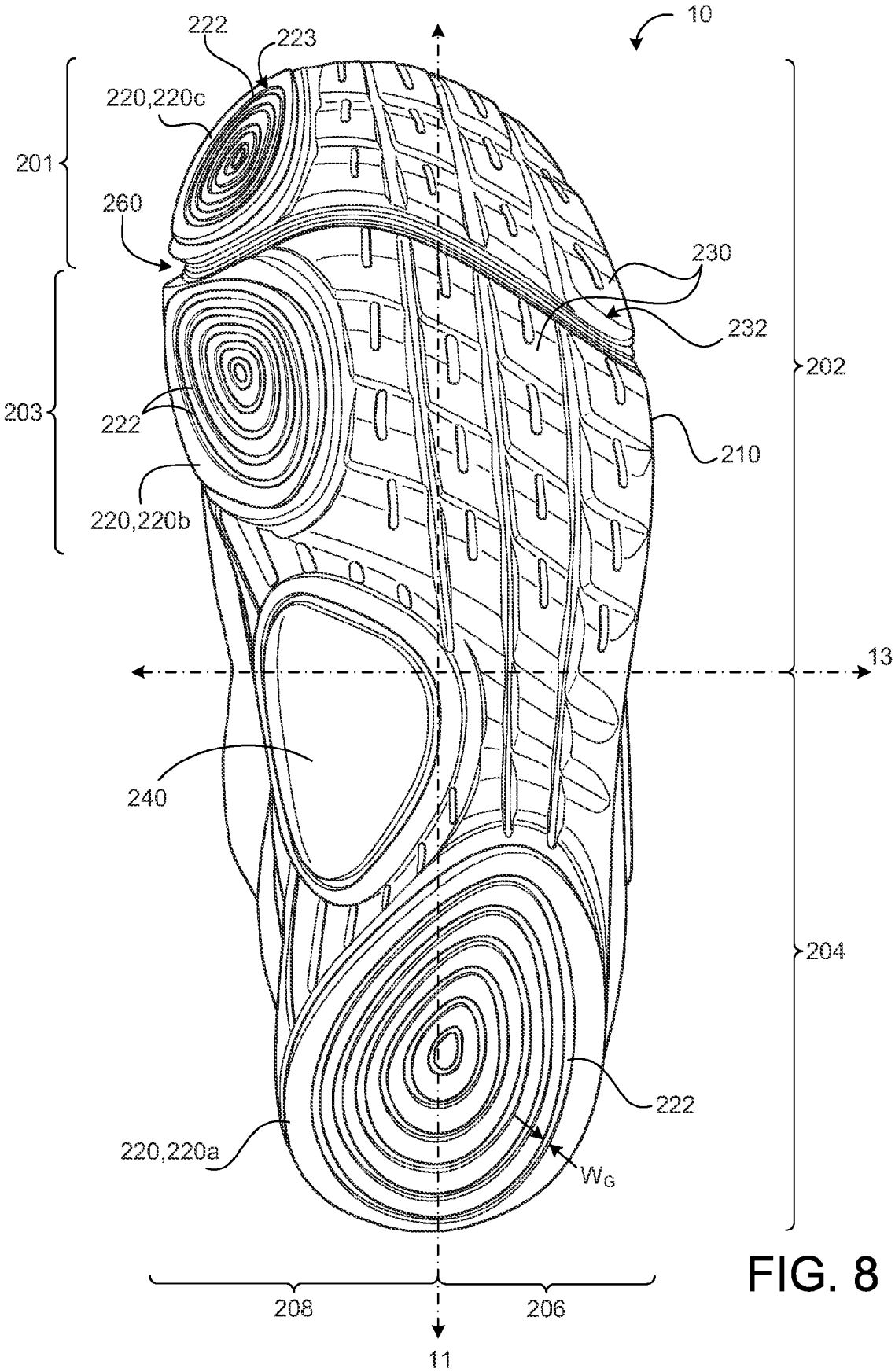
FIG. 8 is a alternative bottom view of the article of footwear shown in FIG. 1.

In the examples shown, the sole assembly 200 includes a first ground contact pad 220*a* disposed in the heel portion 204 of the sole assembly 200 and second and third ground contact pads 220*b*, 220*c* disposed in the forefoot portion 202 of the sole assembly 200, optionally on the medial portion 208 thereof. The second ground contact pad 220*b* may be disposed in a metatarsus region 203 (e.g., in a medial metatarsus region) of the forefoot portion 202 and the third ground contact pad 220*c* maybe disposed in a phalanges or toe region 201 of the forefoot portion 202 (e.g., in a medial phalanges region) (FIG. 8). The bending feature 260 can be positioned or arranged between or overlapping both the toe region 201 and the metatarsus region 203 to allow or facilitate bending of the two respective regions of the sole assembly 200 with respect to each other.

In general, gait is the way of locomotion using limbs. Different gaits are characterized by differences in limb movement patterns, overall velocity, forces, kinetic and potential energy cycles, and changes in surface contact with the ground. A foot strike of a walking or running stride is one variable that defines a person's gait and is generally how the foot contacts the ground and/or which part of the foot first contacts the ground. For example, in a forefoot strike, the ball of a foot lands first; in a midfoot strike, the heel and ball of the foot land simultaneously; and in a heel strike, the heel of foot lands first and then pronates to the ball of the foot.

Referring to FIGS. 10A-11B, in some implementations, the ground contact pads 220*a-c* are positioned in areas of relatively high initial ground contact, which experience relatively higher rates of wear than other portions of the sole assembly 100. In the examples shown, the first ground contact pad 220*a* is positioned and sized to cover at least a majority of the base body 210 in the heel portion 204 of the sole assembly 200, which typically receives initial contact with the ground (or substantially simultaneously with the metatarsus region 203 of the sole assembly 200). The second ground contact pad 220*b* can be positioned and sized to cover a portion of the base body 210 and in an intersection of the metatarsus region 203 and the medial region 208 of the sole assembly 200 (i.e., a medial metatarsus region). The third ground contact pad 220*c* can be positioned and sized to cover a portion of the base body 210 in the phalanges or toe region 201 substantially under the hallux ("big toe" or medial most toe) of a received foot (i.e., a medial phalanges region).

Figure 10B:
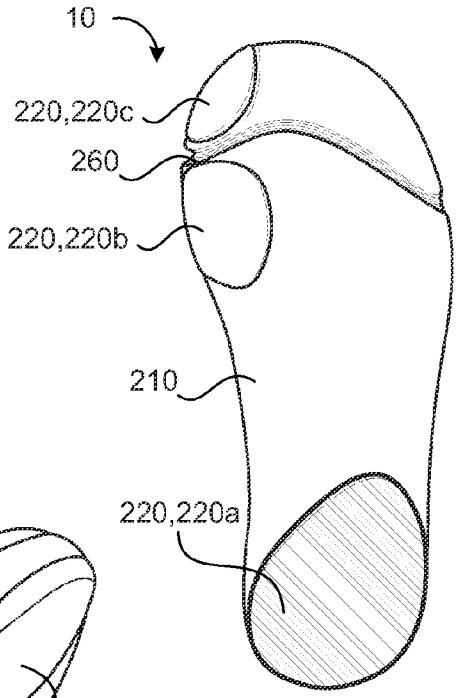
FIG. 10B is a bottom view of the article of footwear shown in FIG. 10A, indicating ground contact with the heel ground contact pad.
Figure 10A:
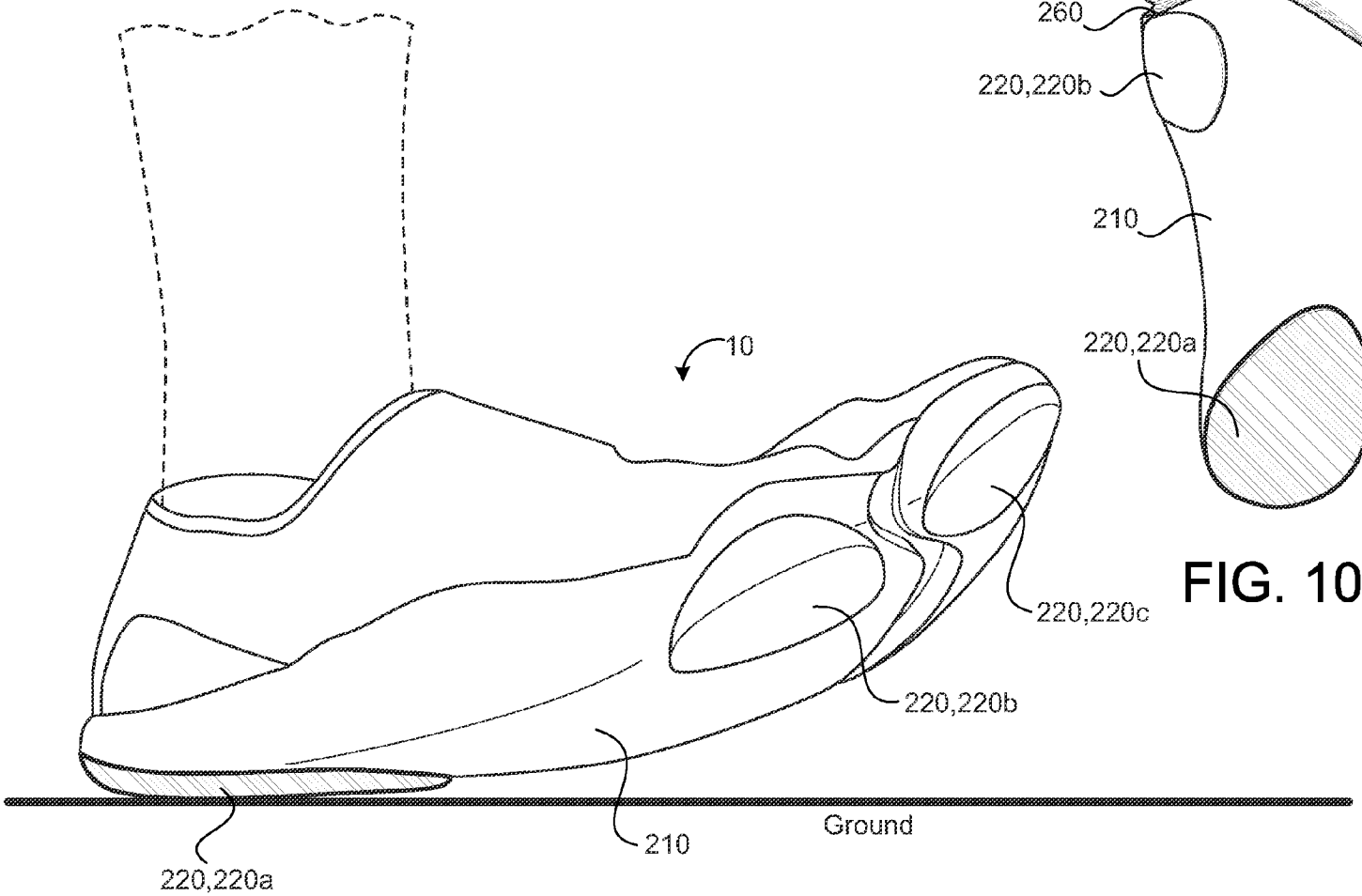
FIG. 10A is a side perspective view an exemplary article of footwear having a heel ground contact pad about to receive contact with the ground.
Figure 11B:
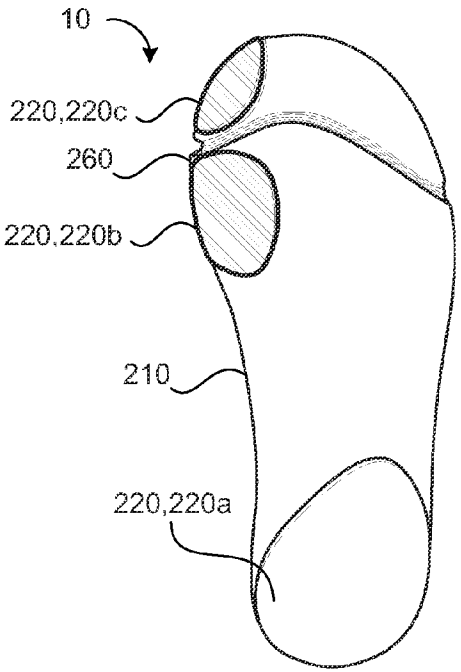
FIG. 11B is a bottom view of the article of footwear shown in FIG. 11A, indicating ground contact with the forefoot ground contact pads.
Figure 11A:
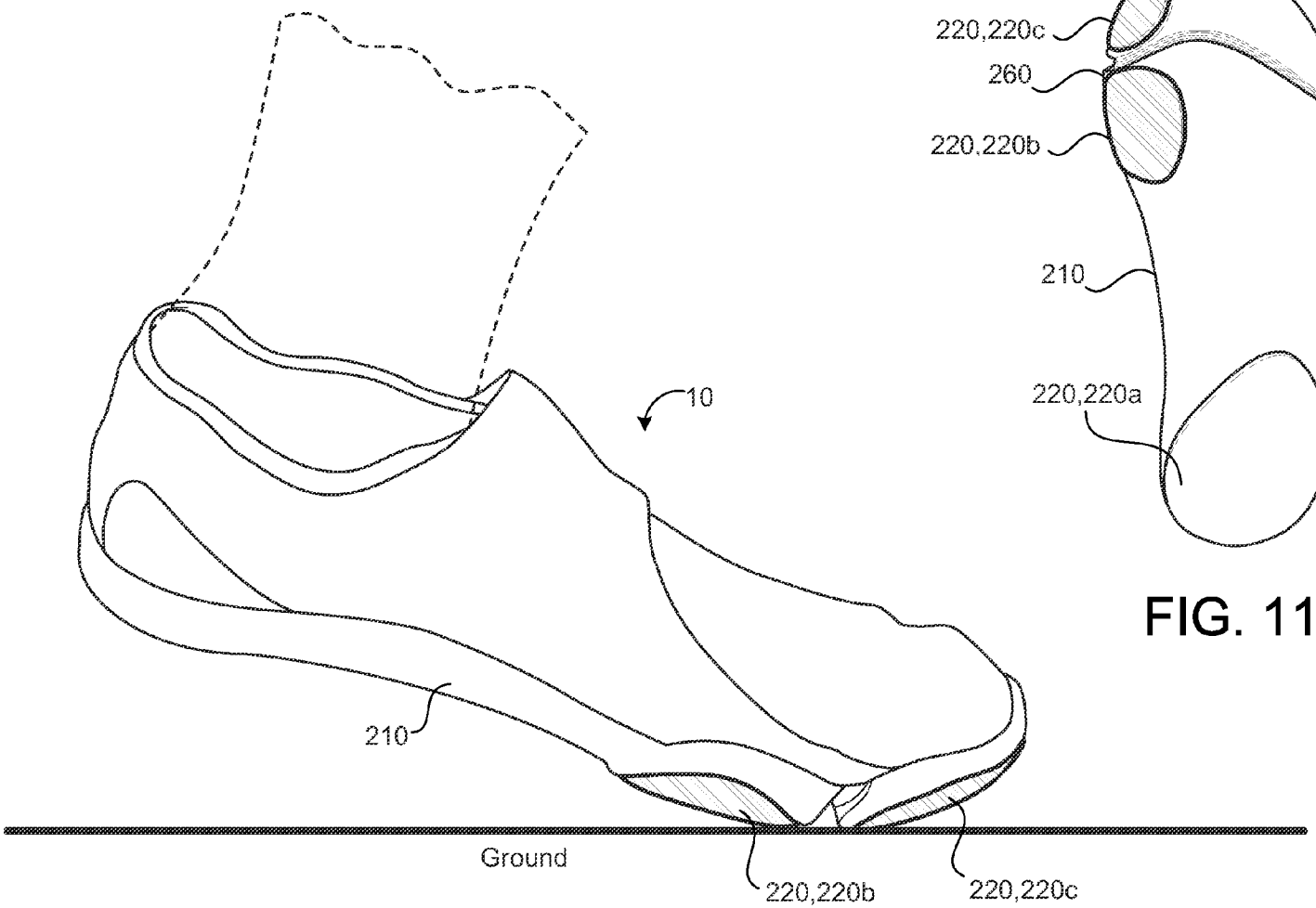
FIG. 11A is a side perspective view an exemplary article of footwear having a forefoot ground contact pads about to receive contact with the ground.

FIG. 10A illustrates the first ground contact pad 220*a* of the shoe 10 receiving initial contact with the ground during a foot strike phase of a running stride. FIG. 11A illustrates the second and third ground contact pads 220*b*, 220*c* of the shoe 10 receiving contact with the ground during the foot strike phase as the user's foot pronates from the heel toward the hallux (big toe) of the foot before departure from the ground. FIGS. 10B and 11B illustrate the ground contact pads 220*a-c* generally receiving the relatively highest concentration of ground contact and friction forces during a ground contact phase of a running stride.

Referring again to FIG. 9, the sole assembly 200 may have a thickness $T_S$ that is equal or substantially equal between the forefoot portion 202 and the heel portion 204. This provides substantially no heel lift and a one-to-one ratio between the thickness $T_S$ of the forefoot heel portions 202, 204. This may assist the foot strike of a person with a forefoot strike or mid-strike gait.

Referring to FIGS. 5-7 and 8, the sole body 210 may define lugs 230 for traction at least in the forefoot portion 202 of the sole assembly 200. At least some of the lugs 230 may have a heelward shoulder edge 232 at the bottom surface 212 of the sole body 210 along the ground contact surface 205 of the sole assembly 200 that defines a right angle or substantially a right angle having a non-radiused or non-chamfered corner (or substantially non-radiused or non-chamfered) for grabbing the ground surface and providing traction. The sole body 210 may define an arch support pod 240 in between or overlapping the forefoot and heel portions 202, 204 of the sole assembly 200 in the medial portion 208 of the sole assembly 204 between the first and second ground contact pads 220*a*, 220*b*. The ground contact pod 240 has a bottom surface common with the ground contact surface 205 of the sole assembly 200. The arch support pod 240 may be configured to provide support for a user's foot arch. Moreover, the arch support pod 240 may receive ground contact during a foot strike.

A number of implementations have been described. Nevertheless, it will be understood that various modifications may be made without departing from the spirit and scope of the disclosure. Accordingly, other implementations are within the scope of the following claims.

What is claimed is:

1. An article of footwear comprising:

a sole defining a bending feature between a phalanges portion and a metatarsus portion of the sole, the bending feature allowing the phalanges sole portion to articulate upward with respect to the metatarsus sole portion; and an upper attached to the sole, the upper defining a foot void and having a phalanges portion that defines at least one toe receiver volume, the at least one toe receiver volume defining a raised shape with respect to an adjacent metatarsus portion of the upper;

wherein articulation of the phalanges sole portion and substantially unrestricted toe lift movement into the at least one toe receiver volume allows substantially unrestricted upward toe flexion of a received foot in the foot void;

wherein the upper comprises:

an enclosure layer; and a reinforcing layer disposed on at least a forefoot portion of enclosure layer, the reinforcing layer having webs extending from a common location in a medial forefoot portion of the upper to spaced locations near a lateral edge of the upper.

2. The article of footwear of claim 1, wherein the common location is near a foot receiving opening defined by the upper.

3. The article of footwear of claim 1, wherein the reinforcing layer extends continuously along a periphery of the forefoot portion of the enclosure layer.

4. The article of footwear of claim 1, wherein the webs define an arcuate path.

5. The article of footwear of claim 1, wherein the reinforcing layer comprises at least one of a thermoplastic polyurethane and a heat pressed rubber.

6. The article of footwear of claim 1, wherein the enclosure layer has an inner surface and an outer surface, the inner enclosure layer surface being the inner most surface of the upper and the outer enclosure layer surface being the outermost surface for a portion of the upper.

7. An article of footwear comprising:

a sole defining a bending feature between a phalanges portion and a metatarsus portion of the sole, the bending feature allowing the phalanges sole portion to articulate upward with respect to the metatarsus sole portion;

an upper attached to the sole, the upper defining a foot void and having a phalanges portion that defines at least one toe receiver volume, the at least one toe receiver volume defining a raised shape with respect to an adjacent metatarsus portion of the upper;

a first strap having a first end secured to one of lateral and medial heel portions of the upper near a foot receiving opening defined by the upper and a free second end releasably securable to the other of the lateral and medial heel portions of the upper; and a second strap having a first end secured to a medial portion of the upper near the foot receiving opening opposite of the first strap and a free second end releasably securable to a lateral portion of the upper, wherein articulation of the phalanges sole portion and substantially unrestricted toe lift movement into the at least one toe receiver volume allows substantially unrestricted upward toe flexion of a received foot in the foot void.

8. The article of footwear of claim 7, wherein the first end of the first strap is connected directly to the enclosure layer.

9. The article of footwear of claim 7, wherein the second ends of the first and second straps are releasably securable to the upper using hook and loop fasteners.

10. An article of footwear comprising:

a sole; and an upper attached to the sole, the upper comprising:

an enclosure layer; and a reinforcing layer disposed on at least a forefoot portion of enclosure layer, the reinforcing layer having webs extending from a common location in a medial forefoot portion of the upper to spaced locations near a lateral edge of the upper.

11. The article of footwear of claim 10, wherein the common location is near a foot receiving opening defined by the upper.

12. The article of footwear of claim 10, wherein the reinforcing layer extends continuously along a periphery of the forefoot portion of the enclosure layer.

13. The article of footwear of claim 10, wherein the webs define an arcuate path.

14. The article of footwear of claim 10, wherein the reinforcing layer comprises at least one of a thermoplastic polyurethane and a heat pressed rubber.

15. The article of footwear of claim 10, wherein the enclosure layer has an inner surface and an outer surface, the inner enclosure layer surface being the inner most surface of the upper and the outer enclosure layer surface being the outermost surface for a portion of the upper.

16. The article of footwear of claim 10, further comprising:

a first strap having a first end secured to one of lateral and medial heel portions of the upper near a foot receiving opening defined by the upper and a free second end releasably securable to the other of the lateral and medial heel portions of the upper; and a second strap having a first end secured to a medial portion of the upper near the foot receiving opening opposite of the first strap and a free second end releasably securable to a lateral portion of the upper.

17. The article of footwear of claim 16, wherein the first end of the first strap is connected directly to the enclosure layer.

18. The article of footwear of claim 16, wherein the second ends of the first and second straps are releasably securable to the upper using hook and loop fasteners.

19. An article of footwear comprising:

a sole assembly comprising:

a sole body comprising ethylene vinyl acetate;

a first ground contact pad disposed on a heel portion of the sole body;

a second ground contact pad disposed on a medial metatarsus portion of the sole body; and a third ground contact pad disposed on a medial phalanges portion of the sole body;

wherein bottom surfaces of the ground contact pads and a bottom surface of the sole body collectively define a ground contact surface of the sole assembly; and an upper assembly attached to the sole assembly, the upper assembly comprising:

a mesh upper enclosure layer;

a first reinforcing layer disposed on the enclosure layer in a forefoot portion of the upper assembly;

a second reinforcing layer disposed on the enclosure layer in at least a heel portion of the upper assembly;

wherein the first reinforcing layer includes webs extending from a common location in a medial forefoot portion of the upper assembly to spaced locations near a lateral edge of the upper assembly.

20. The article of footwear of claim 19, wherein the enclosure layer has an inner surface and an outer surface, the inner enclosure layer surface being the inner most surface of the upper assembly and the outer enclosure layer surface being the outermost surface for a portion of the upper assembly.

21. The article of footwear of claim 19, wherein the common location is near a foot receiving opening defined by the upper assembly.

22. The article of footwear of claim 19, wherein the first reinforcing layer extends continuously along a periphery of the forefoot portion of the enclosure layer.

23. The article of footwear of claim 19, wherein the webs define an arcuate path.

24. The article of footwear of claim 19, wherein the first reinforcing layer comprises at least one of a thermoplastic polyurethane and a heat pressed rubber.

25. The article of footwear of claim 19, wherein the second reinforcing layer comprises a synthetic suede.

26. The article of footwear of claim 19, further comprising:

a first strap having a first end secured to one of lateral and medial heel portions of the upper assembly near a foot receiving opening defined by the upper assembly and a free second end releasably to the other of the lateral and medial heel portions of the upper assembly; and a second strap having a first end secured to a medial portion of the upper assembly near the foot receiving opening opposite of the first strap and a free second end releasably securable to a lateral portion of the upper assembly.

27. The article of footwear of claim 26, wherein the first end of the first strap is connected directly to the enclosure layer.

28. The article of footwear of claim 26, wherein the first and second straps extend continuously from the second reinforcing layer as a unitary piece.

29. The article of footwear of claim 26, wherein the second ends of the first and second straps are releasably securable to the upper using hook and loop fasteners.

30. The article of footwear of claim 19, wherein the bottom surface of the sole body defines traction lugs having a heelward shoulder.

31. The article of footwear of claim 30, wherein the shoulder of the traction lug defines a substantially right angle edge having a substantially non-radiused corner.

32. The article of footwear of claim 19, wherein the sole body defines a bending feature between a phalanges portion of the sole body and a metatarsus portion of the sole body for allowing articulation of the phalanges sole body portion with respect to the metatarsus sole body portion.

33. The article of footwear of claim 32, wherein the bending feature comprises a defined groove.

34. The article of footwear of claim 19, wherein the sole body defines a ground contact pod in a medial portion of the sole body between the first and second ground contact pads, the ground contact pod having a bottom surface common with the ground contact surface of the sole assembly.

35. The article of footwear of claim 19, wherein the ground contact pads comprise carbon rubber.

36. The article of footwear of claim 19, wherein the ground contact pads define concentric grooves.

37. The article of footwear of claim 36, wherein at least one groove of each ground contact pad defines a shoulder having a substantially non-radiused edge.

38. The article of footwear of claim 19, wherein a thickness of a forefoot portion of the sole assembly is substantially equal to a thickness of a heel portion of the sole assembly.

39. An article of footwear comprising:

a sole; and an upper attached to the sole, the upper comprising:

a mesh enclosure layer extending from a toe end of the upper to a heel end of the upper;

a thermo plastic polyurethane reinforcing layer applied to an outer surface of the mesh enclosure layer in a forefoot portion of the upper; and a non-woven reinforcing layer applied to the outer surface of the mesh enclosure layer in a heel portion of the upper;

wherein the non-woven reinforcing layer defines a first strap extending from a medial portion of the upper proximate a foot opening defined by the upper to a distal free end releasably securable to a lateral portion of the upper; and wherein the non-woven reinforcing layer defines a second strap extending from one of lateral and medial heel portions of the upper near the foot opening to a distal free end releasably securable to the other of the lateral and medial heel portions.

* * * * *